US006165071A

United States Patent [19]

Weiss

[11] Patent Number: 6,165,071

[45] Date of Patent: Dec. 26, 2000

[54] METHOD AND APPARATUS FOR GAMING IN A SERIES OF SESSIONS

[75] Inventor: Steven A. Weiss, Las Vegas, Nev.

[73] Assignee: Casino Data Systems, Las Vegas, Nev.

[21] Appl. No.: 08/858,470

[22] Filed: May 20, 1997

[51] Int. Cl.[7] ..... A63F 9/24

[52] U.S. Cl. ..... 463/24; 463/16; 463/4

[58] Field of Search ..... 463/1–5, 25, 29, 463/40, 7, 8, 30, 31, 34–36, 43; 364/410.1

[56] References Cited

U.S. PATENT DOCUMENTS

| | | | |
|---|---|---|---|
| 4,108,361 | 8/1978 | Krause | 235/375 |
| 4,764,666 | 8/1988 | Bergeron | 463/25 |
| 4,858,930 | 8/1989 | Sato | 463/24 |
| 4,882,473 | 11/1989 | Bergeron et al. | 463/25 |
| 4,918,603 | 4/1990 | Hughes et al. | 364/410 |
| 5,018,736 | 5/1991 | Pearson et al. | 273/493 |
| 5,179,517 | 1/1993 | Sarbin et al. . | |
| 5,411,259 | 5/1995 | Pearson et al. | 463/36 |
| 5,429,361 | 7/1995 | Raven et al. . | |
| 5,586,936 | 12/1996 | Bennett et al. . | |
| 5,655,961 | 8/1997 | Acres et al. | 463/27 |
| 5,813,912 | 9/1998 | Shultz | 463/25 |
| 5,846,132 | 12/1998 | Junkin | 463/42 |
| 5,970,143 | 10/1999 | Schneier et al. | 463/29 |

*Primary Examiner*—Valencia Martin-Wallace
*Assistant Examiner*—John M Hotaling, II
*Attorney, Agent, or Firm*—Bernhard Kreten

[57] ABSTRACT

A method and apparatus which allows player gaming to transpire over a series of sessions without a player losing credit for performances in earlier sessions. A player card carries thereon the current status of the player's performance during the course of previous sessions and it updated during subsequent sessions. Milestones are recognized as opportunities for providing the player with awards as these milestones are achieved.

27 Claims, 4 Drawing Sheets

METHOD AND APPARATUS FOR GAMING IN A SERIES OF SESSIONS

FIELD OF THE INVENTION

The following invention relates generally to instrumentalities and methodologies in the gaming environment. More specifically, the instant invention is directed to a method and apparatus for allowing game play to occur over a protracted period of time in a series of sessions at the discretion of the player.

BACKGROUND OF THE INVENTION

Casinos continually search for new games which encourage players to spend more time wagering. One way of stimulating player interest involves the award of a larger pay off. Another strategy involves introduction of games that are novel and appeal to a player's desire for novelty and strategies which increase the interest level of the player. Another technique is to combine the two above-identified strategies for increasing the potential player payout and player stimulation by novel games.

A further trend is to provide games which can only be consummated over a somewhat protracted period of time. An example of such a game involves tournament play in which a player is awarded an initial number of credits and the play is intended to continue over a period time at the end of which awards are made for the participants in the tournament based on having enjoyed distinguished performance over that time period. Tournament play increases the duration of time during which the player participates, but large numbers of people are still excluded from a tournament type of environment for any of a number of reasons. One common reason for not participating in a tournament involves the player's obligation to discontinue play for other activities. This necessarily decreases the total number of participants who have the desire to play for protracted periods but are unable to commit the time in one session.

Apart from tournament play, the industry in general would still like to develop games that encourages a player to participate in an outcome that involves sustained play over a protracted period of time. This would be analogous to "frequent usage or participation" programs that reward an individual for ongoing loyalty to a particular entity. Various devices have been introduced in the industry which allow a player to be "tracked" by the gaming establishment so that it is easier to reward a player who has demonstrated a penchant for either long term play or play involving a relatively large amount of money. One example involves player identification cards which are downloaded into the gaming machines that allows the player's activity as a function of time to be recorded. Many players, however, are reluctant to participate in what they may view as a form of surveillance and therefore player tracking instrumentalities in which the player is identified has been met with only moderate acceptance by players.

SUMMARY OF THE INVENTION

The instant invention is distinguished over the known prior art in a multiplicity of ways. For one thing, the instant invention allows the player the opportunity to initiate play or discontinue play at his own whim as a function of time over a series of sessions. Equally as important, however, is the ability to provide the player with a game format in which the incentive to continue play over a protracted period of time includes milestones as a function of performance in the underlying game itself.

For example, many sporting activities transpire over the course of a season. Example could include football, baseball, basketball, racing, hockey, etcetera. These types of sports involve a plurality of individual games played with different opponents during the course of a season. The instant invention allows such a season and a series of games to be simulated in a wagering environment. An ancillary feature of the instant invention includes performance milestones which may make the player eligible for enhanced awards based on having achieved the milestones. These performance milestones can be correlated to either status of the sports team that the player simulatively "owns and/or operates" or could be reflective of individual performances of individual players on a team. Examples include nomination of a team into the playoffs or nomination of a player on the team to all-star status. Comparative records of multiple players engaged in similar sport games could form a comparative award based on team performance, player performance or the establishment of new player records heretofore unattained. Examples include most yards gained rushing, highest free throw percentage, longest home run, fastest lap time, most hat tricks scored, best team record, best earned run average, and the like.

In a preferred form of the invention, these desiderata can be achieved by providing a gaming machine, a player card having a memory integrally formed therewith and means for reading information contained on the player memory card. The player memory card provides an up to the minute encapsulation of the player's status during the course of play and is updated at the end of each playing session. When play has progressed for a protracted period of time, again at the player's discretion, supplemental awards are available to the player as the result of progress based on milestones established for the particular game. This allows the player to redeem credits directly correlated to performance as a function of time during the plural sessions comprising the simulative event.

OBJECTS OF THE INVENTION

A primary object of the present invention is to provide a new, novel and useful method and apparatus for allowing protracted play of one or more similar gaming machines over a series of sessions.

A further object of the present invention is to provide a method and apparatus as characterized above in which the player is provided with a memory card that stores thereon updates with respect to the progress of the player during the course of a series of plays defining the player's participation.

A further object of the present invention is to provide a device as characterized above which allows the player to select when the player wants to play and cease playing at the player's sole discretion. The player can play the same game on one or several machines without losing the game status.

A further object of the present invention is to provide a method and device as characterized above which is intuitive to use and enhances the player's enjoyment.

A further object of the present invention is to provide a method and device as characterized above which is durable in construction and lends itself to mass production techniques.

A further object of the present invention is to provide a method and device as characterized above which increases the enjoyment of the player and allows the player to post results over a duration of time for subsequent ranking and evaluation.

Viewed from a first vantage point it is an object of the present invention to provide a gaming apparatus, comprising in combination: a display means, a processor having means to drive a display means, an outcome generator operatively coupled to the processor to control gaming results of the processor and its driving of the display means, a plurality of inputs enabled by a player allowing the player to initiate and sustain play of the gaming apparatus, and a player memory card including memory storage means on the card removably accessible to the processor to upload and download information between the processor and the player memory card reflective of status of an ongoing game.

Viewed from a second vantage point it is an object of the present invention to provide a method for gaming involving a machine and game capable of being played, in a series of sessions over a protracted period of time, the steps including: providing a player memory card, reading the present status of a game either at the beginning of a game while in progress, or at the end of the game from the player memory card, playing the game based on the present status of the game as reflected on the player memory card, and writing an update of the new status of the game on the player memory card at the end of a session when the player present elects to stop playing.

These and other objects will be made manifest when considering the following detailed specification when taken in conjunction with the appended drawing figures.

DESCRIPTION OF PREFERRED EMBODIMENTS

Figure 1:
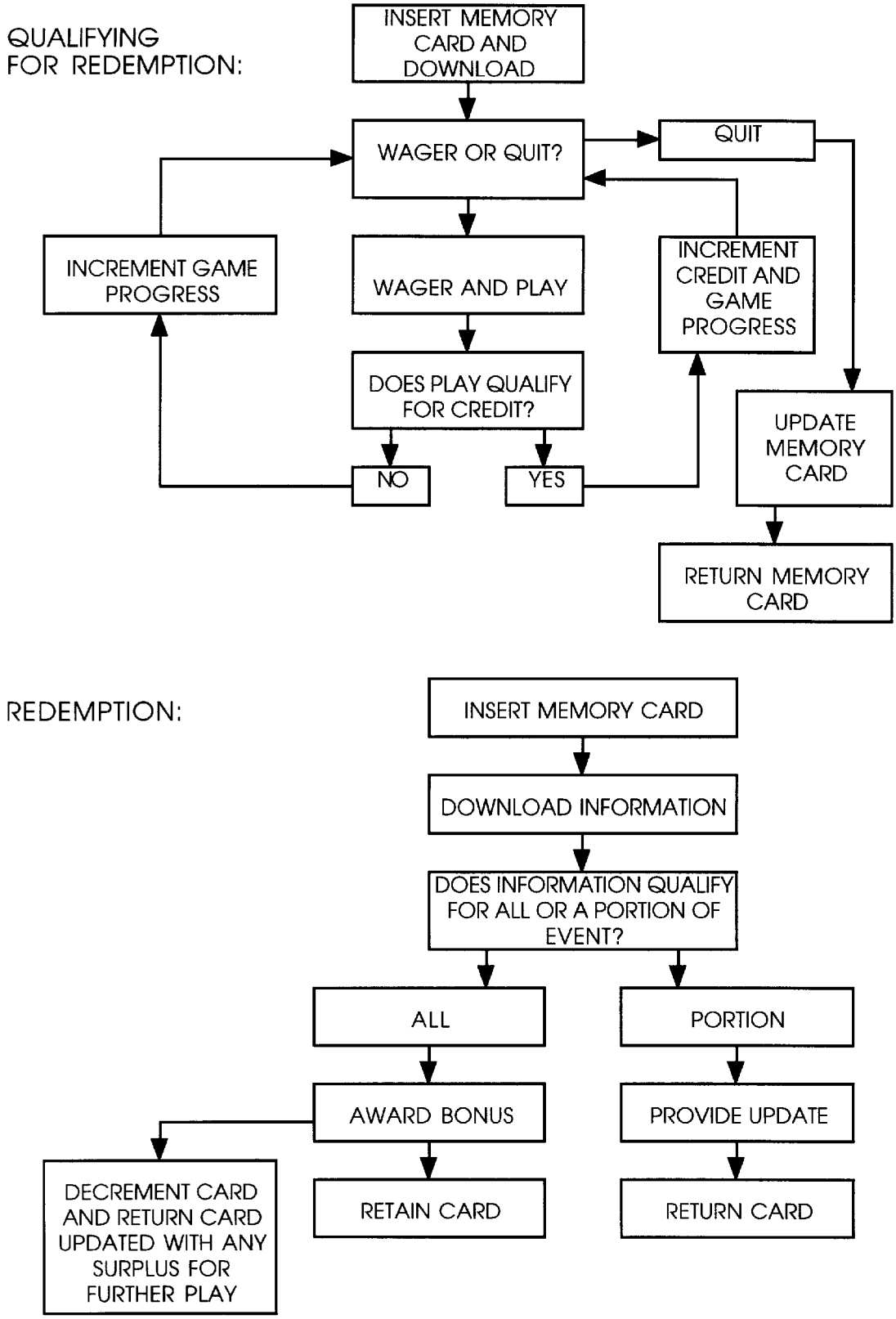
FIG. 1 is a flow chart of the instrumentality according to the present invention.

Referring to the drawings, wherein like reference numerals denote like parts throughout the various drawing figures, reference numeral 10 is directed to the apparatus according to the present invention.

In its essence, the invention includes a machine 10 that includes an input output device 6 for reception of a player memory card 20 that the machine 10 can read and write to. The invention may also include a separate stand alone station 110 where the player can take the player memory card 20 for a status diagnostic including the relative ranking of the player during the course of play or at the end of the set period for play including an opportunity to redeem awards associated with player performance.

Figure 2:
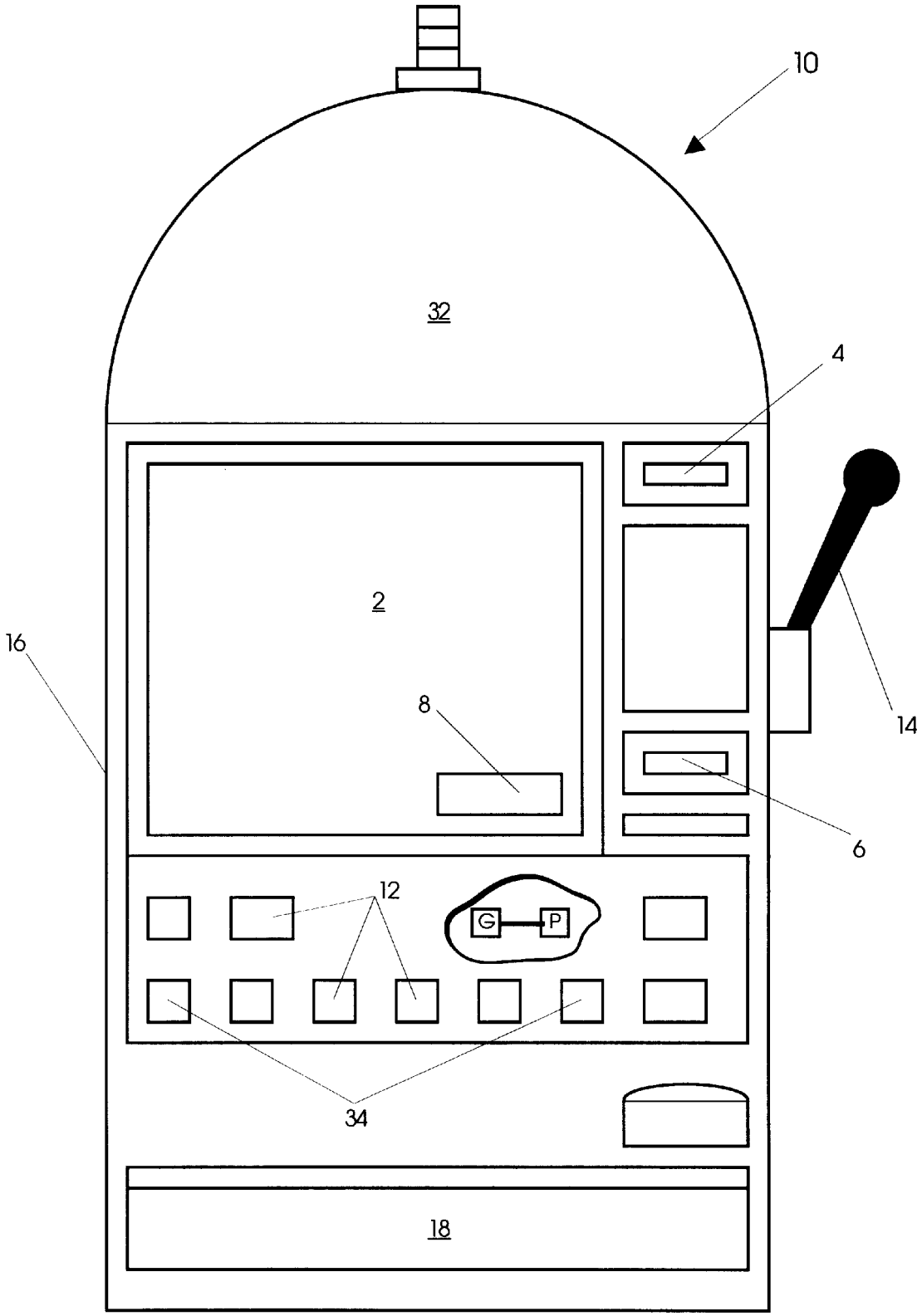
FIG. 2 is a depiction of a gaming machine allowing the FIG. 1 flow chart to be utilized therewith.

More particularly, and with reference to FIG. 2, the gaming machine 10 is shown according to one form of the invention. The machine 10 includes a housing 16 that supports therewithin, a display 2, an area for receiving a wager 4, an input slit 6 to receive a player memory card 20, a window 8 within the display 2 that allows supplemental information to be received thereon, a plurality of decision making buttons 12 and optionally a handle 14 which can be used in lieu of one of the decision making buttons 12 in order to initiate play of the game. In addition, a payout hopper 18 can be included for a redeeming awards based on play in using the machine 10. The machine includes a random number generator G and a processor P.

Figure 3:
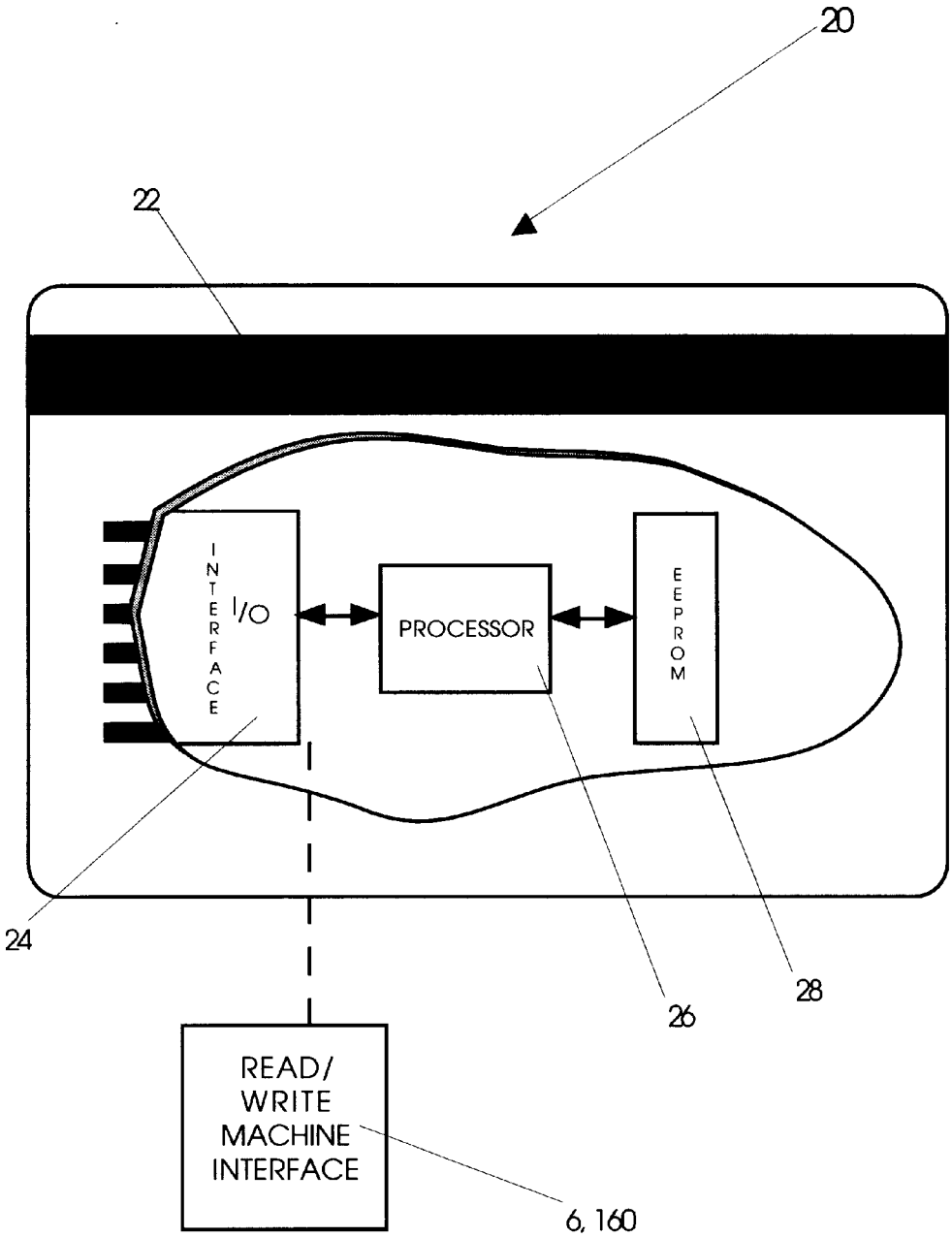
FIG. 3 is a drawing reflecting the interaction between a player memory card and a source of uploading and downloading.

FIG. 3 reflects details of the player memory card 20 and its relationship to a read write machine interface that lies behind the slit 6 that receives the player memory card 20. More particularly, the player memory card 20 can be configured as a substantially planar rectangular piece of plastic which can include encoding on a magnetic strip 22 and includes an input output interface 24 that can be read by the read write machine interface 6 shown in FIG. 2 and 3. In essence, the input output interface 24 is operatively coupled to an integrally formed processor 26 contained in the player memory card 20 and the processor 26 interfaces with an electrically erasable and programmable read only memory 28 so that the ongoing status of the player's gaming activities can be uploaded and downloaded to and from the memory card 20 to and from the machine 10. The magnetic strip 22 can include other information if desired, such as player identification or a form of encryption for detecting the validity of the player memory card 20. In addition, the processor 26 and its memory 28 can be included with encryption or decoding means so that appropriate "handshaking" can occur between the machine interface and the card 20 to minimize the likelihood of cards which have been updated by an improper, unauthorized technique.

Figure 4:
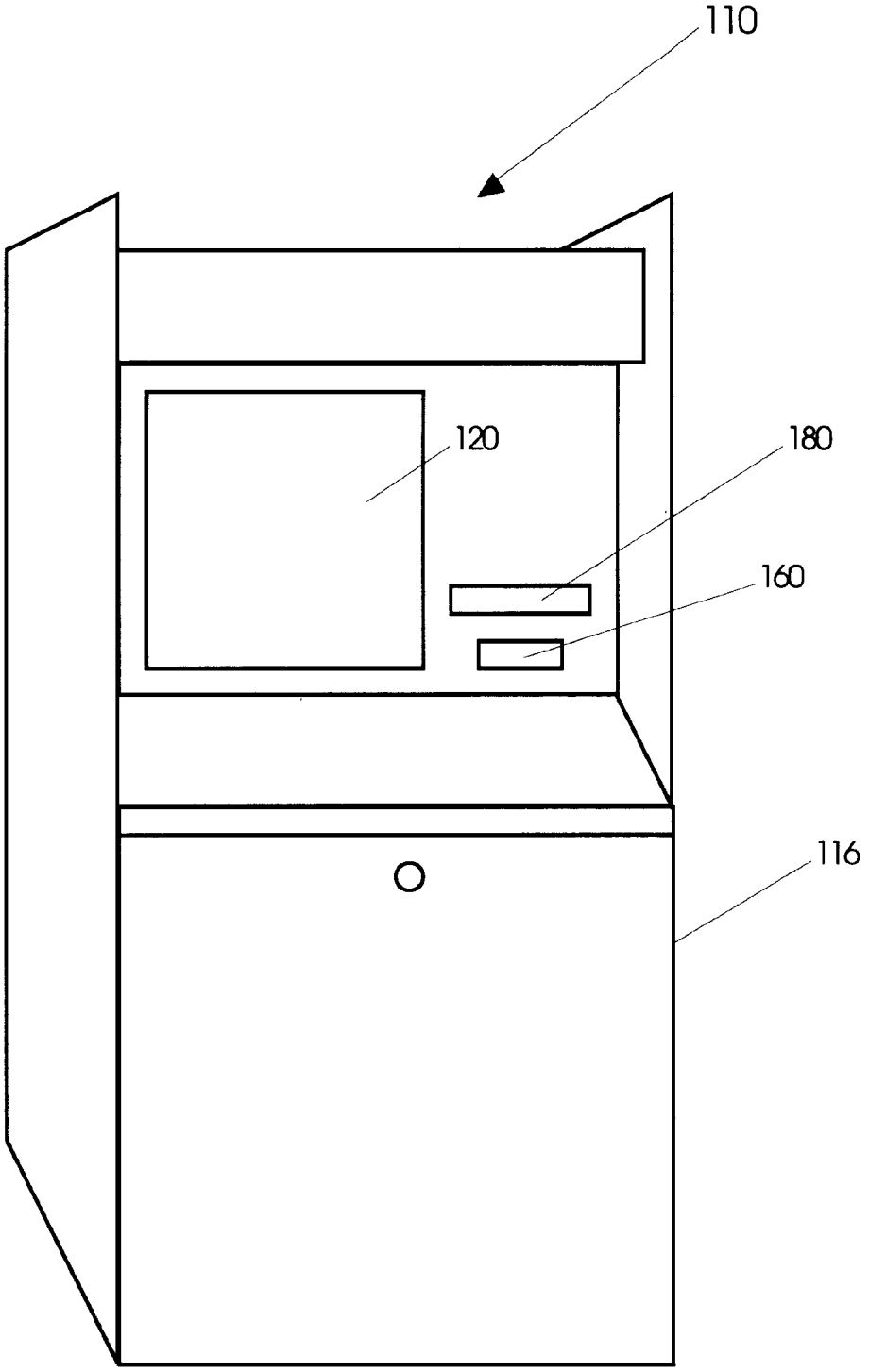
FIG. 4 reflects a redemption apparatus.

Referring to FIG. 4, a redemption center 110 is shown. The redemption center 110 preferably includes a cabinet 116 which houses a display 120, an input 160 for receiving the player memory card 20 and an output 180 which distributes to the player an award. The output 180 can be in the form of redemption vouchers, scrip, currency or other indicia of value that the player can subsequently utilize or redeem. The display 120 provides the player with an update with respect to the progress the player is currently enjoying in the game associated with the player memory card 20 and can include ranking of the player vis a vis other people similarly competing in analogous games. Should the underlying game involvement be a tournament type play endeavor, that information can also be reflected on the display screen 120. Referring to FIG. 1, the methodology for qualifying for redemption and actual redemption by the player is depicted.

With respect to qualifying for redemption, the player first receives a player memory card 20 which can include a prompt pre-programmed therein either via the magnetic stripe 22 or from the memory 28 and processor 26 through input output 24 that describes the game selected by the player. For example, assume the player initially decides to engage in a simulative baseball type game. The face of the card opposite that shown in FIG. 3 may depict a baseball environment. The card is accessible to the player at display racks located in the casino. The player may have the option of identifying himself at the redemption station (FIG. 4) to initialize the game with an identity personal to the player but only at his sole discretion. This step is not necessary should the player decide to remain untracked. Next the player, as shown in FIG. 1 inserts the memory card which is downloaded into the machine 10. The machine receives a signal from the card 20 announcing the type of game the player expects to play. Alternatively, and preferably the machine may be "single purpose" machines in which the player must take a baseball card and correlate it with a machine that is exclusively calibrated for baseball. In this preferred form, the machine 10 includes baseball associated indicia such as on panel 32 of the machine 10 in FIG. 2. In all cases, the display 2 will display baseball correlative indicia on the display 2 to further provide correlation for the benefit of the player. Sounds evocative of baseball may emanate from a speaker or speakers 34 shown on the machine 10 of FIG. 2.

Upon receipt of the memory card and its having been downloaded through the read write interface associated with slit 6, the machine prompts the player for a wager. Should the player decide to commence play, a wager is decremented from any credits that the player has posted via wagering input 4 in conjunction with decision making buttons 12 and optionally with handle 14. The wager and the play continues as shown in FIG. 1 resolving itself in an outcome that either qualifies the player for credit or not. Should credits not be due, the game progress is incremented (for example one out in the first inning becomes two outs). The player is again prompted for either a further wager or secession. Should the player qualify for a credit, the counter, such as the window 8 shown on the display 2 is incremented with respect to further game progress and the player is again then prompted for further wagering or to retire. Should the player elect to quit, the memory card 20 is updated and then returned to the player via the slit 6.

For redemption, the bottom portion of FIG. 1 shows one way of effecting redemption which can occur either through the machine 10 or preferably through a redemption center 110 remote from the machine 10. When the redemption is to occur at the machine 10, the decision making buttons are appropriately manipulated in order to provide the player with the earned benefits and the card is returned after having been decremented based on any award due the player. Considering both FIGS. 1 and 4 in detail, should there be a stand alone redemption area, the redemption machine 110 receives the card 20 of the player in slot 160 and this information on the card is downloaded via a read write machine interface such as the one shown in FIG. 3. The interface 160 then displays information on the screen 120 and allows the player to receive an award through outlet 180. If the card status coincides with an award in which there are no residual benefits, an award is made and in one form of the invention the card can be retained by the machine. On the other hand, the bonus could be awarded with the card decremented and updated and returned to the player with an update so that any surplus remaining on the card can be utilized for further play by the player. If the player merely request a status report with respect to the player performance vis a vis other criteria, the update is provided on the screen 120 and then the card is returned to the player for further play. It could be that a game in progress has milestones that allows the performing player to receive incremental awards as a function of play. Thus, the portion which earns an award can be harvested by the player through outlet 180 as desired.

Assume that the game simulation is baseball. The player memory card should be capable of storing data at least with respect to the player's performance both by inning, by game, by season and by post season competition. In addition, pitching and batting performance for the player can be stored on the card for subsequent analysis to award benefits to the player as a function of having achieved milestones. For example, selection to an all star team during the course of the season may make the player eligible for bonus awards during an intermediate portion of the season. Similarly, most valuable player awards can be determined post season and during a play off. This information is stored on the player memory card at the end of each gaming session and is downloaded into the machine 10 prior to the next play by the player.

Similarly, assume that the game chosen by the player is evocative of football. The card 20 has on a surface remote from that shown in FIG. 3 with indicia correlative with a football motif and similarly, the gaming machine will reflect displays commonly associated with football. As with baseball, the player engaging upon football wagering can be identified both as to team, team leaders, team progress and play offs. Interim awards can be enabled based on rushing or passing statistics, defensive prowess, etcetera.

Assume that the game chosen is evocative of basketball. The face of the card 20 remote from that which shown in FIG. 3 preferably includes indicia thereof symbolically evocative of a basketball game. Similarly, the machine 10 will be tailored with indicia correlative of a basketball motif. Individual player performance (such as free throw percentage, assists, three point shots, etc.) and team performance including post season activity can be recorded on the card 20 for subsequent awards.

Assume that the card 20 includes indicia thereof indicative of a racing environment. The machine 10 will include indicia correlative with the racing environment, such as race performance during the course of a campaign.

Assume that the motif associated with the game is evocative of hockey. The card 20 will include indicia thereon suggestive of the hockey environment as will the machine 10. Performance criteria normally associated with hockey, the players and post season performance will also be available for downloading onto the player card 20 for subsequent evaluation and awards.

Assume that the game involved involves tournament type play. Typically and heretofore, the play must be concluded all in one session. More players are believed to be amenable to tournament play if the tournament were extended over a larger period of time (assume the player is on a vacation for a week) so long as the aggregate amount of player time does not exceed the maximum allowable time for the tournament. Thus, the card 20 would chronicle not only the player activity but the player activity as a function of time. In all examples, time can also be an element in the games delineated hereinabove. This is especially true for games such as basketball, football and hockey where the duration of play is time related.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming apparatus, comprising in combination:

a display means displaying a game theme characterized as a series of game events which transpire over a protracted season, a processor having means to drive said display means and advance said game theme, a random number generator operatively coupled to said processor to control gaming results of said processor and its driving of said display means, a plurality of inputs including wagering means enabled by a player and allowing the player to initiate and sustain play of said gaming apparatus, and a player memory card including memory storage means on said card removably accessible to said processor to upload and download information between said processor and said player memory card reflective of present status of an ongoing game, said information reflective of said present status of said game theme temporally current with said protracted season.

2. The gaming apparatus of claim 1 wherein said game theme simulates a real sporting event counterpart characterized by a series of increments which parallel rules and goals of its non-simulative sporting event counterpart and each increment in said series requires the player enabling said wagering means in order to progress through said protracted season.

3. The gaming apparatus of claim 2 wherein said protracted season is comprised of a plurality of discrete sporting events, each of said discrete sporting events having at least one rule which determines when an end of one said discrete sporting events occurs.

4. The gaming apparatus of claim 3 wherein said sporting event is taken from a group of sporting events characterized by marking said end of discrete sporting event as a function of time elapsed, distance traversed or sporting event game units completed.

5. The gaming apparatus of claim 4 wherein said sporting event is taken from the group including baseball, basketball, football, hockey and racing.

6. The gaming apparatus of claim 5 wherein said memory storage means includes an electrically erasable and programmable read only memory for storing said present status of the player's game theme which can be uploaded and downloaded to and from the memory card to and from said processor.

7. The gaming apparatus of claim 6 further including a redemption apparatus having an input for receiving the player memory card and an output which distributes to the player an award.

8. The gaming apparatus of claim 6 further including a redemption apparatus having an input for receiving the player memory card and an output means for viewing said present status report with respect to the player's performance.

9. The apparatus of claim 4 including all star games and playoff games.

10. A method for gaming involving a machine and a game capable of being played in a series of session over a protracted period of time, the steps including:

providing a game having a game theme formed from several individual game events, providing a player a player memory card and reading the present status of the game from the player memory card, playing the game based on the present status of the game as reflected on the player memory card, and writing an update of the new status of the game on the player memory card at the end of a session when the player present elects to stop playing.

11. The method of claim 10 wherein the step of playing the game includes the step of playing a game on the machine which having a sports motif which includes playing of plurality of individual game events played against simulative opponents during a season.

12. The method of claim 11 including awarding the player as a function of performance versus other players in a tournament.

13. The method of claim 12 wherein the sports game is a simulative baseball type game.

14. The method of claim 12 including simulating the sports game as a football type game.

15. The method of claim 12 including simulating the sports game as a basketball type game.

16. The method of claim 12 including simulating the sports game as a hockey type game.

17. The method of claim 12 including simulating the sports game as a racing type game.

18. A method for gaming involving a gaming apparatus, the steps including:

providing a player a player memory card, reading a present status of a game either at a beginning of the game, while in progress, or at the end of the game from the player memory card, configuring the game with a game theme characterized as a series of game events which transpire over a protracted period of time, allowing the player to play the game based on the present status of the game as reflected on the player memory card, and writing an update of a subsequent status of the game on the player memory card at the end of a session when the player present elects to stop playing thereby defining a subsequent effective game status correlative to a beginning game state, in progress game state, or an end of game state.

19. The method of claim 18 further including allowing the player to play the game in a series of sessions over a period of time.

20. The method of claim 19 further including writing an update of a new game status of the game on the player memory card at the end of each session in the series of sessions over the period of time wherein each update defines the subsequent effective game status correlative to a beginning game state, in progress game state, or an end of game state.

21. The method of claim 20 further including reading each previously stored subsequent effective game status at a beginning of each session in the series of sessions to reinstate the game to the previously stored subsequent effective game status for allowing the player to play the game in a series of sessions over the period of time.

22. The method of claim 21 wherein the step of playing the game over a period of time in the series of sessions includes the step of retaining the player's performance for each session played in the series of sessions.

23. The method of claim 22 wherein the step of retaining the player's performance for each session played in the series of sessions includes the step of writing an update of the player's performance on the player memory cards at the end of each session played in the series of sessions.

24. The method of claim 23 further including the step of providing performance milestones, which when achieved, make the player eligible for enhanced awards.

25. The method of claim 24 further including the step of correlating the performance milestones to the status of game play.

26. The method of claim 24 further including the step of correlating the performance milestones to the performance of the player.

27. The method of claim 26 including configuring the game as a sports motif which has a protracted season.

* * * * *